United States Patent [19]

Fodor et al.

[11] 4,173,455

[45] Nov. 6, 1979

[54] FIRE-SAFE HYDROCARBON FUELS

[75] Inventors: George E. Fodor; William D. Weatherford, Jr.; Bernard R. Wright, all of San Antonio, Tex.

[73] Assignee: The United States of America as represented by the Secretary of the Army, Washington, D.C.

[21] Appl. No.: 950,501

[22] Filed: Oct. 11, 1978

[51] Int. Cl.[2] ..... C10L 1/18

[52] U.S. Cl. ..... 44/51; 44/71; 44/72; 252/308; 252/309

[58] Field of Search ..... 44/51, 71, 72; 252/308, 252/309

[56] References Cited

U.S. PATENT DOCUMENTS

| | | | |
|---|---|---|---|
| 2,736,641 | 2/1956 | Mallson et al. | 44/71 |
| 2,805,135 | 9/1957 | Bell et al. | 44/71 |
| 2,892,694 | 6/1959 | Weeks | 44/51 |
| 3,527,581 | 9/1970 | Brownawell et al. | 44/51 |
| 4,002,435 | 1/1977 | Wenzel et al. | 44/51 |
| 4,083,698 | 4/1978 | Wenzel et al. | 44/51 |

*Primary Examiner*—Winston A. Douglas
*Assistant Examiner*—J. V. Howard
*Attorney, Agent, or Firm*—Nathan Edelberg; Robert P. Gibson; Muzio B. Roberto

[57] ABSTRACT

A stabilized, fire-safe, aqueous hydrocarbon fuel emulsion prepared by mixing: a diesel fuel; an emulsifier (consisting of oleyl diethanolamide, diethanolamine, and diethanolamine soap of oleic acid) which has been treated with about 0–7½ of oleic acid. A modified version of this fuel also contains 0–0.5% of an antimisting agent, and water.

10 Claims, No Drawings

FIRE-SAFE HYDROCARBON FUELS

The invention described herin may be manufactured, and licensed by or for the Government for Governmental purposes without the payment to us of any royalties thereon.

BACKGROUND OF INVENTION

This invention relates to diesel fuel emulsions having utility as engine fuels. If ignited, these fuels are self-extinguishing even if the liquid temperature is above the flash point of the base diesel fuel.

In the storage of diesel fuel or the utilization of the fuel to drive a vehicle, a potential fire hazard is presented. While in storage for military use in war time, for example, the fuel may be subjected to an enemy incendiary projectile attack. When in actual combat, the fuel system of a military vehicle may be struck by a projectile and set afire. In addition, accidents such as rear-end collisions also result in the loss of lives and property through fire. The present invention minimizes the potential for fire in the above mentioned instances. In addition, the diesel fuels of the present invention are stable for an extended period of time. The emulsification of hydrocarbons is disclosed in the following patents:

a. U.S. Pat. No. 2,892,694, issued June 30, 1959 (L. E. Weeks). The patent discloses an emulsion comprising, (1) kerosene and JP4 fuels, (2) an emulsifier of 10–80% by weight of the fuel consisting of alkyl-4-sulfaphthalate and a base compound selected from ammonia, amines and alkylalamines having 1 to 5 carbon atoms, and (3) 8–50% water.

b. U.S. Pat. No. 3,527,581, issued Sept. 8, 1970 (D. W. Brownawell et al). The patent discloses an emulsion comprising, (1) diesel or jet fuel, (2) surfactants such as a fatty acid of 12 to 20 carbon atoms; alkyl phenols having an alkyl group of 8 or more carbon atoms; amino compounds selected from the group consisting of alkylene polyamines, alkanolamines and the salts of these amines with the fatty acids, and (3) 1 to 30% water.

c. U.S. Pat. No. 4,083,698, issued Apr. 11, 1078 (E. C. Wenzel et al). The patent discloses an emulsion comprising, (1) a gasoline, diesel or fuel oil, (2) a surface active agent comprising a long-chain fatty acid salt, or, more preferably an ammonium or sodium long-chain fatty acid salt or mixture thereof; an unsaturated long-chain fatty acid, or a mixture of a free unsaturated organic acid and a free saturated long-chain fatty acid; and a non-ionic surfactant and (3) 0.1 to 10% water.

d. U.S. Pat. No. 4,002,435, issued Jan. 11, 1977 (E. C. Wenzel et al). The patent discloses, (1) a hydrocarbon, (2) 0.10 to 10% water and (3) a surfact active agent consisting of, (a) a mixture of ammonia and sodium oleate, (b) an organic acid, and (c) an ethylene oxide condensation product.

However, none of the above identified patents disclosed the utilization of the present emulsifier in combination with a diesel fuel or the beneficial results occuring therefrom as will be described hereinafter.

BRIEF SUMMARY OF THE INVENTION

The aqueous diesel fuel emulsion contains 2 to 6% by volume of an emulsifier consisting of at least 60% oleyl diethanolamide, 8 to 14% by weight diethanolamine soap of oleic acid, 16 to 24% by weight free diethanolamine to which emulsifier has been added 0 to 7½% by weight oleic acid under conditions causing it to react with an equivalent amount of free diethanolamine, thereby leaving essentially no free oleic acid in the final emulsifier blend. In another aspect of the invention, up to 0.5% by weight of an antimist agent, based on the weight of the emulsion, may be utilized.

It is an object of this invention to provide and disclose a fire-safe fuel.

It is a further object of this invention to provide and disclose a novel stabilized aqueous diesel fuel emulsion.

It is a further object of this invention to provide and disclose a novel stabilized aqueous diesel fuel emulsion for use in existig engines with little or no modifications.

It is a further object of this invention to provide and disclose a novel stabilized aqueous diesel fuel emulsion which is self-extinguishing at liquid temperatures above the flash point of the base diesel fuel.

It is a further object of this invention to provide and disclose a stabilized aqueous diesel fuel emulsion having reduced exhaust particulate emissions.

It is a further object of this invention to provide and disclose a stabilized aqueous diesel fuel emulsion having improved engine thermal efficiency.

It is a further object of this invention to provide and disclose a stabilized aqueous diesel fuel emulsion which has a long shelf life.

Other objects may be ascertained from the following description of the invention and the claims.

DETAILED DESCRIPTION OF INVENTION

The present emulsifier is prepared utilizing a commercial grade oleyl diethanolamide, diethanolamine, and diethanolamine soap of oleic acid. It is typified by products sold under the trade names of SCHERCOMID ODA by Scher Chemicals, Inc. of Clifton, N.J. and LT-17-43-1 by Clintwood Chemicals of Chicago, Ill. However, equivalent products are available from other manufacturers. The emulsifier incorporated into the diesel fuel may contain additional oleic acid derivatives formed from addition of up to about 7½% by weight of additional oleic acid.

The emulsion is prepared by adding at room temperature the emulsifier to the diesel fuel in an amount of 2–6% by volume with mechanical agitation. Water in an amount of 1–17% is subsequently added with additional mechanical agitation to produce the desired emulsion. Intense homogenization is not required.

The oleic acid is incorporated into the emulsifier prior to the addition of the emulsifier to the diesel fuel. In a specific example, 7.5 grams of commercially available oleic acid were added to 100 grams of SCHERCOMID, ODA. The mixture was heated to a temperature of about 55° C. and held at that temperature for about 10 minutes. The emulsifier was permitted to cool to room temperature. The emulsifier was then ready to be added to the diesel fuel. Mechanical agitation was also used in the incorporation of the oleic acid in the emulsifier.

In another aspect of the invention, an antimist agent may be utilized in the preparation of the present emulsion.

Antimist agents are long-chain, high molecular weight polymers, i.e. with average molecular weights in excess of 5 million, that were developed to improve the flow of oil through pipelines. The presence of an antimist agent in the emulsion of the present invention prevents the fuel from atomizing on impact when a fuel container is ruptured. Instead of forming droplets which develop into an explosive fireball, the fuel is expelled in "sheets" and "strings of beads" and therefore does not provide sufficient surface area for explosive combustion. The addition of about 5% water is adequate to make ground fires self-extinguishing at temperatures above the flash point of the diesel fuel. A higher water content of the emulsion which does not have the antimisting agent serves to reduce the explosive fireball and make ground fires self-extinguishing.

The antimist agent may be added at any time during the preparation of the emulsion, or when all of the components have been added, i.e., after the addition of the water. The antimist agent is added with low-shear agitation, i.e., less than 100 rpm with a propeller-type mixer, to the diesel fuel or the resultant emulsion. A commercial antimist agent known under the trade name of CDR or AM-1 (Continental Oil Company) was utilized. Since the agent is proprietary, the composition is not known. Similar products are available from other manufacturers.

The present invention results in the production of a stable emulsion of extremely fine droplets of water in a fuel. The mean droplet size is less than 1,400 angstroms. Since the stability of an emulsion is related to the size of the water droplets, it would be expected that the fuel mixtures would have a shelf life comparable to that of the unblended fuel. Although some diesel fuels have a shelf life of up to 5 years, most fuels are utilized in within 9 months. The microemulsions of the present invention have remain unchanged at ambient temperatures for over 6 months as of the present time.

The following samples of the present emulsion were produced. These samples were prepared from a referee grade diesel fuel meeting MIL-F-46162A (MR)II specifications. Deionized water or water containing up to 300 ppm total dissolved solids as calcium nitrate or as calcium bicarbonate was used:

| EXAMPLE I | EXAMPLE II |
|---|---|
| 84% base fuel (by volume) | 92% base fuel (by volume) |
| 10% water (by volume) | 5% water (by volume) |
| 6% above described emulsifier which has not been treated with additional oleic acid. | 3% emulsifier* (by volume) |
| | 0.2% antimist agent (by wt) |

EXAMPLE III

93% base fuel (by volume)
5% water (by volume)
2% emulsifier* (by volume)

-continued 0.2% antimist agent (by wt)

*Above described emulsifier treated with 5% by weight of oleic acid.

TABLE 1

| Property | Base Fuel | #I (Above) | #II (Above) |
|---|---|---|---|
| Flame propagation across bulk liquid surface at 77° C. | Normal | None | Delayed Propagation |
| Flammability of spray at 77° C. | Extreme | Moderate | NIL |
| Ballistic test at 77° C. | Catastrophic fire | Transient fireball with self-extinguishing ground fire | Diminished transient fireball with self-extinguishing ground fire |
| Flash Point °C. | 60 | * | * |
| Fire Point °C. | 91 | ** | 104 |
| PIpeline Corrosion Test | *** | *** | *** |

*Could not be determined as generated steam extinguished pilot flame of flash point apparatus.
**Could not be determined due to severe bumping of sample.
***Pass NACE STANDARD TM-01-72.

The ballistic tests were conducted utilizing 76 liters of fuel in a horizontal 114 liter drum at 77° C. using 20 mm high explosive incediary tracer rounds (HEIT).

A CLR direct-injection, single-cylinder diesel engine, instrumented for combustion studies, was used to investigate the performance of an aqueous fuel emulsion prepared in accordance with Example I. The engine evaluations covered the range of 20:1, to 65:1 air fuel ratio at engine speeds of 1500 rpm and 3000 rpm. These conditions cover the upper 75% load range of normal engine operation. This initial study was conducted without modifying the CLR engine to accommodate the fuel other than allowing volumetric over-fueling by removal of the rack stop. This CLR diesel engine as well as multicylinder military diesel engine (LDT-465-1C) has been repeatedly started, operated and idled without difficulty on this type of fuel formulation.

The results of these CLR engine tests demonstrated that exhaust gas temperatures are reduced by more than 50° C. In addition, the present emulsion example #I was found to reduce exhaust particulate emissions at equal power levels. These emissions are measured as "smoke" with a Public Health Service capacity meter at full rack conditions. At equal power input conditions, i.e., 20:1 air-fuel ratio with the base fuel, the water-containing fuel reduced smoke from a 5% opacity to 3%.

Also these tests demonstrated that thermal (i.e., enthalpy) efficiency may be improved by the use of this fuel formulation as a direct replacement for diesel fuel, depending upon operating conditions. That is, when the present emulsified fuel is compared with the base fuel, based on equal combustion energy feed rate, the engine power may be greater than the engine power of the base fuel, depending upon engine speed and load.

Although our experimentation has been directed to diesel fuels, it is understood that other hydrocarbon fuels such as jet fuels, e.g., JP-8, JP-5, Jet A, Jet A-1, are also operable.

Having described our invention we claim:

1. A stabilized aqueous diesel fuel emulsion comprising: (a) 1–17% by volume of water, (b) 2–6% by volume of an emulsifier consisting of at least 60% oleyl diethanolamide, 8 to 14% by weight diethanolamine soap of oleic acid, 16 to 24% by weight free diethanolamine, to which emulsifier has been added 0 to 7½% by weight oleic acid under conditions causing it to react with an equivalent amount of free diethanolamine, thereby leaving essentially no free oleic acid in the final emulsifier blend, (c) 0–0.5% by weight of an antimist agent with average molecular weight of at least 5 million, and (d) the remainder being a diesel fuel.

2. An emulsion in accordance with claim 1 wherein the water droplet sizes are less than 1,400 angstroms.

3. An emulsion in accordance with claim 1 wherein the emulsifier consists of at least 60% oleyl diethanolamide, 8 to 14% by weight diethanolamine soap of oleic acid, 16 to 24% by weight free diethanolamine, to which emulsifier has been added 0 to 7½% by weight oleic acid under conditions causing it to react with an equivalent amount of free diethanolamine, thereby leaving essentially no free oleic acid in the final emulsifier blend.

4. A stabilized aqueous diesel fuel emulsion comprising: 10% by volume water, 6% by volume of an emulsifier consisting of at least 60% oleyl diethanolamide, 8 to 14% by weight diethanolamine soap of oleic acid, 16 to 24% by weight free diethanolamine, to which emulsifier has been added 0 to 7½% by weight oleic acid under conditions causing it to react with an equivalent amount of free diethanolamine, thereby leaving essentially no free oleic acid in the final emulsifier blend, and the remainder being a diesel fuel.

5. A stabilized aqueous diesel fuel emulsion comprising 10% by volume water, 6% by volume of an emulsifier consisting of at least 60% oleyl diethanolamide, 8 to 14% by weight diethanolamine soap of oleic acid, 16 to 24% by weight free diethanolamine, to which emulsifier has been added 5% by weight oleic acid under conditions causing it to react with an equivalent amount of free diethanolamine, thereby leaving essentially no free oleic acid in the final emulsifier blend, and the remainder being a diesel fuel.

6. A stabilized aqueous diesel fuel emulsion comprising 10% by volume water, 6% by volume of an emulsifier consisting of at least 60% oleyl diethanolamide, 8 to 14% by weight diethanolamine soap of oleic acid, 16 to 24% by weight free diethanolamine to which emulsifier has been added, 2½% by weight oleic acid under conditions causing it to react with an equivalent amount of free diethanolamine, thereby leaving essentially no free oleic acid in the final emulsifier blend, and the remainder being a diesel fuel.

7. A stabilized aqueous diesel fuel emulsion comprising 10% by volume water, 5% by volume of an emulsifier consisting of at least 60% oleyl diethanolamide, 8 to 14% by weight dithanolamine soap of oleic acid, 16 to 24% by weight free diethanolamine to which emulsifier has been added, 2½% by weight oleic acid under conditions causing it to react with an equivalent amount of free diethanolamine, thereby leaving essentially no free oleic acid in the final emulsifier blend, and the remainder being a diesel fuel.

8. A stabilized aqueous diesel fuel emulsion comprising 5% by volume water, 2% by volume of an emulsifier consisting of at least 60% oleyl diethanolamide, 8 to 14% by weight diethanolamine soap of oleic acid, 16 to 24% by weight free diethanolamine, to which emulsifier has been added, 5% by weight oleic acid under conditions causing it to react with an equivalent amount of free diethanolamine, thereby leaving essentially no free oleic acid in the final emulsifier blend, 0.2% by weight of an antimist agent, and the remainder being a diesel fuel.

9. A stabilized aqueous diesel fuel emulsion comprising 5% water by volume, 3% by volume of an emulsifier consisting of at least 60% oleyl diethanolamide, 8 to 14% by weight diethanolamine soap of oleic acid, 16 to 24% by weight free diethanolamine to which emulsifier has been added, 5% by weight oleic acid under conditions causing it to react with an equivalent amount of free diethanolamine, thereby leaving essentially no free oleic acid in the final emulsifier blend, 0.2% by weight of an antimist agent, and the remainder being a diesel fuel.

10. A stabilized aqueous diesel fuel emulsion comprising 5% water by volume, 3% by volume of an emulsifier consisting of at least 60% oleyl diethanolaminde, 8 to 14% by weight diethanolamine soap of oleic acid 16 to 24% by weight free diethanolamine, to which emulsifier has been added, 2½% by weight oleic acid under conditions causing it to react with an equivalent amount of free diethanolamine, thereby leaving essentially no free oleic acid in the final emulsifier blend, 0.2% by weight of an antimist agent, and the remainder being a diesel fuel.

* * * * *